US007952546B2

(12) United States Patent
Sano

(10) Patent No.: US 7,952,546 B2
(45) Date of Patent: May 31, 2011

(54) SAMPLE/HOLD CIRCUIT, ELECTRONIC SYSTEM, AND CONTROL METHOD UTILIZING THE SAME

(75) Inventor: Keiichi Sano, Taipei (TW)

(73) Assignee: Chimei Innolux Corporation, Miao-Li County (TW)

( * ) Notice: Subject to any disclaimer, the term of this patent is extended or adjusted under 35 U.S.C. 154(b) by 799 days.

(21) Appl. No.: 11/768,942

(22) Filed: Jun. 27, 2007

(65) Prior Publication Data

US 2009/0002582 A1 Jan. 1, 2009

(51) Int. Cl.
*G09G 3/36* (2006.01)

(52) U.S. Cl. ..... 345/87; 345/204

(58) Field of Classification Search ..... 345/87–95, 345/204, 206, 212–214, 690, 55, 76, 82; 349/38, 40; 315/169.1, 169.3
See application file for complete search history.

(56) References Cited

U.S. PATENT DOCUMENTS 6,703,995 B2 * 3/2004 Bird et al. ..... 345/87
2006/0181495 A1 * 8/2006 Edward ..... 345/92
2006/0232577 A1 * 10/2006 Edwards et al. ..... 345/211

FOREIGN PATENT DOCUMENTS

WO WO2004090854 10/2004

OTHER PUBLICATIONS

"Late News Paper: Dynamic Self-Refreshing Memory-in-Pixel Circuit for Low Power Standby Mode in Mobile LTPS TFT-LCD" K. Yamashita et al., 2004, pp. 1096-1099.

* cited by examiner

*Primary Examiner* — Amare Mengistu
*Assistant Examiner* — Hong Zhou
(74) *Attorney, Agent, or Firm* — Thomas|Kayden

(57) ABSTRACT

A sample/hold circuit is appropriate for a pixel unit including a liquid crystal capacitor and includes a sampling transistor, a sampling capacitor, a first switching transistor, and a second switching transistor. The sampling transistor is coupled to the liquid crystal capacitor for sampling a voltage stored in the liquid crystal capacitor. The sampling capacitor stores the sampling result. The first switching transistor includes a gate and a source respectively coupled to two terminals of the sampling capacitor. The second switching transistor includes a gate and a drain respectively coupled to the terminals of the sampling capacitor.

18 Claims, 4 Drawing Sheets

SAMPLE/HOLD CIRCUIT, ELECTRONIC SYSTEM, AND CONTROL METHOD UTILIZING THE SAME

BACKGROUND OF THE INVENTION

1. Field of the Invention

The invention relates to a sample/hold circuit, and more particularly to a sample/hold circuit appropriate for a pixel unit comprising a liquid crystal capacitor.

2. Description of the Related Art

Because cathode ray tubes (CRTs) are inexpensive and provide high definition, they are utilized extensively in televisions and computers. Flat-panel displays such as liquid crystal displays (LCD), plasma display panels (PDP), organic electroluminescent displays (OLED), field emission displays (FED), have become the mainstream display device in recent years. When a larger display panel is required, the weight of the flat-panel display does not substantially change.

Liquid crystal displays (LCDs) are widely used, as they possess the favorable advantages of thin profile, light weight, and low radiation. LCDs are frequently utilized in portable devices, such as digital still cameras (DSCs), notebook computers (NBs), personal computers (PCs), and personal digital assistants (PDAs) among others. LCD driving methods include static driving, simple matrix driving, and active matrix driving. Simple matrix driving (also known as passive matrix) comprises a twisted nematic (TN) type and a super twisted nematic (STN) type. Thin film transistors (TFT) are typically utilized in active matrix LCDs.

BRIEF SUMMARY OF THE INVENTION

The invention provides sample/hold circuits. An exemplary embodiment of a sample/hold circuit is appropriate for a pixel unit comprising a liquid crystal capacitor and comprises a sampling transistor, a sampling capacitor, a first switching transistor, and a second switching transistor. The sampling transistor is coupled to the liquid crystal capacitor for sampling a voltage stored in the liquid crystal capacitor. The sampling capacitor stores the sampling result. The first switching transistor comprises a gate and a source respectively coupled to two terminals of the sampling capacitor. The second switching transistor comprises a gate and a drain respectively coupled to the terminals of the sampling capacitor.

The invention further provides electronic systems. An exemplary embodiment of an electronic system comprises a plurality of pixel modules. Each pixel module comprises a pixel unit and a sample/hold circuit. The pixel unit is coupled to a gate electrode and a data electrode, and comprises a driving transistor and a liquid crystal capacitor. The driving transistor is turned on according to a scan signal provided by the gate electrode. The liquid crystal capacitor stores a data signal provided by the data electrode when the driving transistor is turned on. The sample/hold circuit comprises a sampling transistor, a sampling capacitor, a first switching transistor, and a second switching transistor. The sampling transistor is coupled to the liquid crystal capacitor for sampling a voltage stored in the liquid crystal capacitor. The sampling capacitor stores the sampling result. The first switching transistor comprises a gate and a source respectively coupled to two terminals of the sampling capacitor. The second switching transistor comprises a gate and a drain respectively coupled to the terminals of the sampling capacitor.

A control method for the above electronic system is provided. An exemplary embodiment of a control method is described in the following. The data signal is stored in the liquid crystal capacitor via the driving transistor. A voltage stored in the liquid crystal capacitor is sampled. The data signal is stored in the liquid crystal capacitor via the first and the second switching transistors according to the sampling result.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
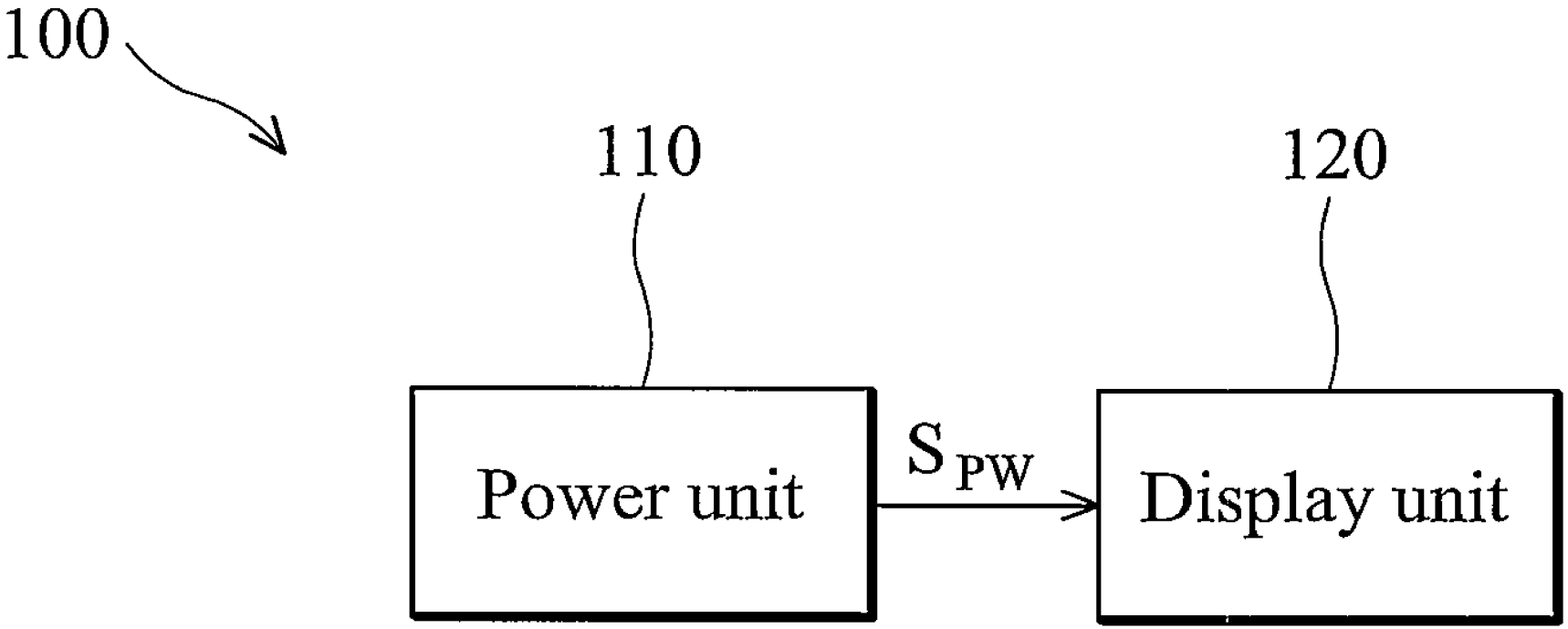
FIG. 1 is a schematic diagram of an exemplary embodiment of an electronic system.

FIG. 1 is a schematic diagram of an exemplary embodiment of an electronic system. Electronic system 100 comprises a power unit 110 and a display unit 120. Power unit 110 provides a power signal $S_{PW}$. Display unit 120 receives the power signal $S_{PW}$ and can display an image. In this embodiment, the electronic system 100 can be a personal digital assistant (PDA), a notebook computer (NB), a personal computer (PC), digital camera, car TV or a mobile telephone.

Figure 2:
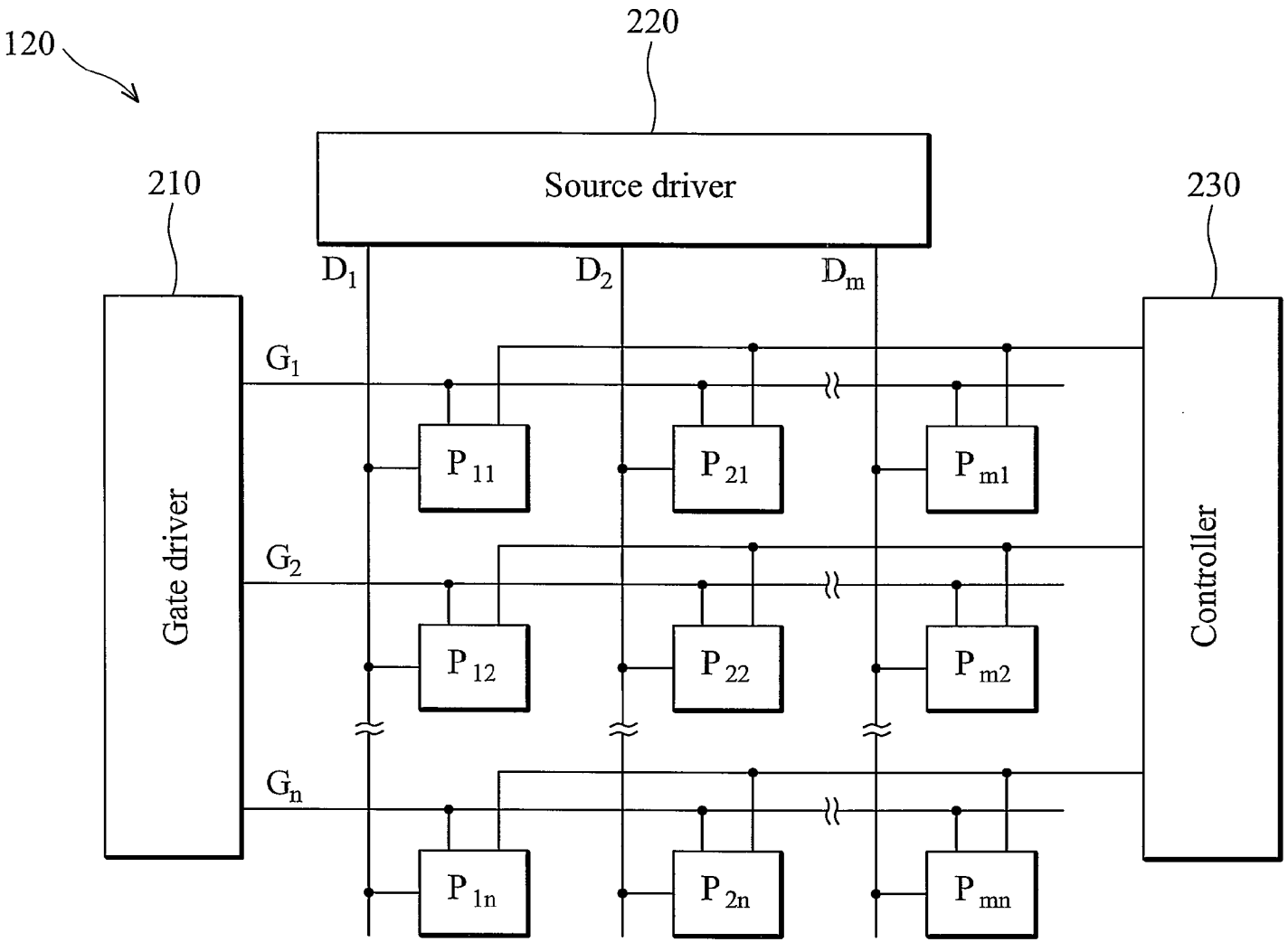
FIG. 2 is a schematic diagram of an exemplary embodiment of the display unit.

FIG. 2 is a schematic diagram of an exemplary embodiment of the display unit. Display unit 120 can be an LCD and comprises a gate driver 210, a source driver 220, a controller 230, and pixel modules $P_{11}$~$P_{mn}$. Gate driver 210 provides scan signals via gate electrode $G_1$~$G_n$. Source driver 220 provides data signals via data electrode $D_1$~$D_m$. Pixel modules $P_{11}$~$P_{mn}$ receive the data signals according to the scan signals. In this embodiment, a frame inversion can be utilized for providing polarity to pixel modules $P_{11}$~$P_{mn}$. The operation voltages of gate driver 210, source driver 220, controller 230, and pixel modules $P_{11}$~$P_{mn}$ are based on the power signal $S_{PW}$.

Figure 3:
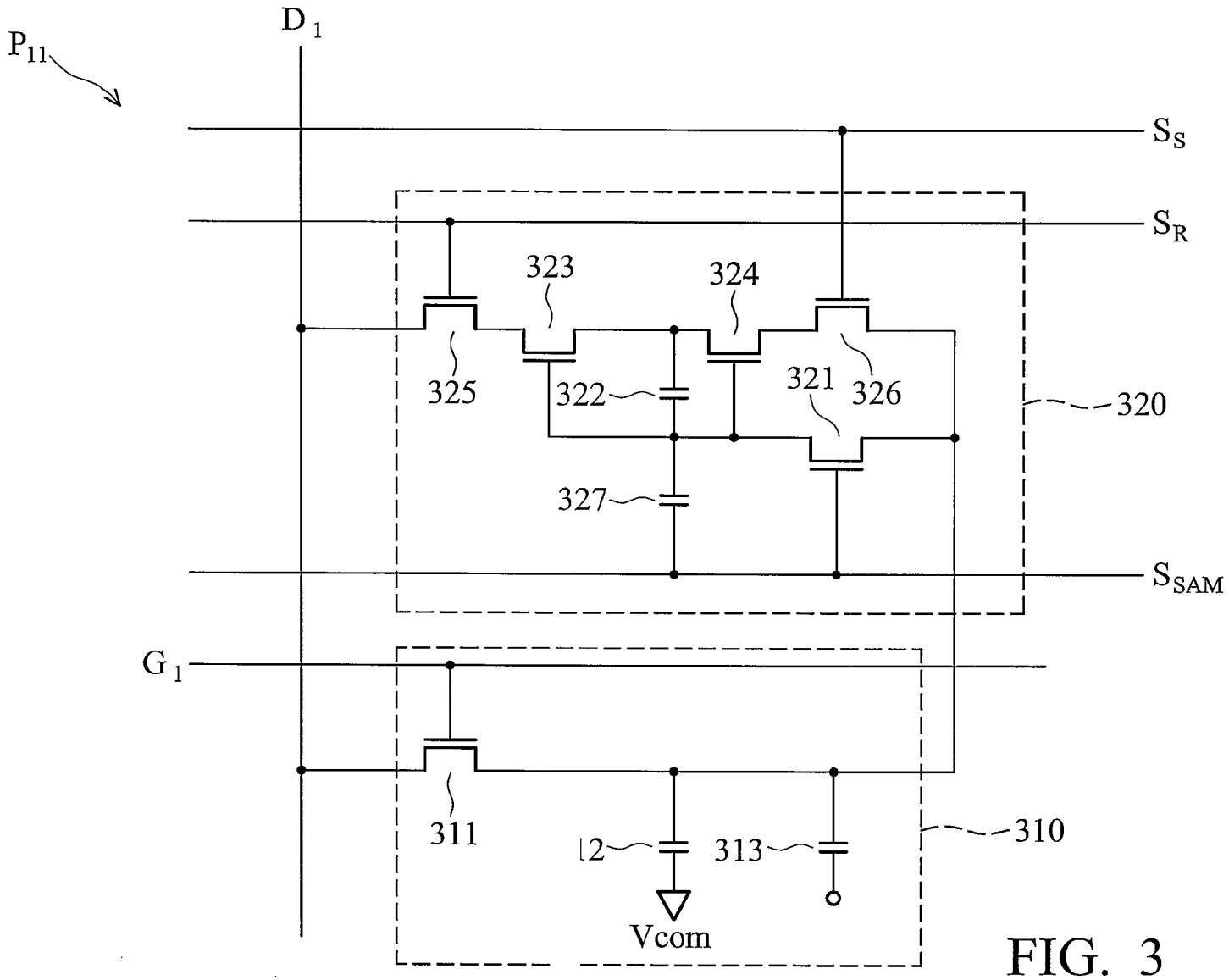
FIG. 3 is a schematic diagram of an exemplary embodiment of the pixel module.

Since pixel modules $P_{11}$~$P_{mn}$ operate on the same principle, pixel module $P_{11}$ is provided as an example. FIG. 3 is a schematic diagram of an exemplary embodiment of the pixel module. Pixel module $P_{11}$ comprises a pixel unit 310 and a sample/hold circuit 320. The pixel unit 310 is coupled to the gate electrode $G_1$ and the data electrode $D_1$ and can comprise a driving transistor 311, a storage capacitor 312, and a liquid crystal capacitor 313. When driving transistor 311 is turned on according to the scan signal provided by the gate electrode $G_1$, storage capacitor 312 and liquid crystal capacitor 313 store the corresponding voltages according to the data signal provided by the data electrode $D_1$.

Sample/hold circuit 320 can comprise a sampling transistor 321, a sampling capacitor 322, switching transistors 323 and 324. Sampling transistor 321 is coupled to liquid crystal capacitor 313 for sampling the voltage stored in liquid crystal capacitor 313. Sampling capacitor 322 stores the sampling result. Switching transistor 323 comprises a gate and a source respectively coupled to two terminals of sampling capacitor 322. Switching transistor 324 comprises a gate and a drain respectively coupled to the terminals of sampling capacitor 322.

When sampling signal $S_{SAM}$ provided by controller 230 is high, sampling transistor 321 samples the voltage stored in liquid crystal capacitor 313 and then stores the sampling result in sampling capacitor 322. Thus, the voltage stored in sampling capacitor 322 is equal to the voltage stored in liquid crystal capacitor 313. For example, if the voltage stored in liquid crystal capacitor 313 is 5V, the voltage stored in sampling capacitor 322 is 5V. Thus, switching transistors 323 and 324 are turned on to provide the data signal provided by data electrode $D_1$ to liquid crystal capacitor 313. Because the data signal provided by data electrode $D_1$ is transmitted to liquid crystal capacitor 313 via another path, the voltage stored in liquid crystal capacitor 313 is further stabilized.

In this embodiment, pixel module $P_{11}$ can further comprise a reference transistor 325 and a separation transistor 326. Reference transistor 325 is coupled between data electrode $D_1$ and switching transistor 323. When reference signal $S_R$ provided by controller 230 is high, reference transistor 325 is turned on for providing a level to sampling capacitor 322. As shown in FIG. 3, reference transistor 325 comprises a drain coupled to data electrode $D_1$, and a source coupled to a drain of switching transistor 323.

Separation transistor 326 is coupled between switching transistor 324 and liquid crystal capacitor 313. When separation signal $S_S$ provided by controller 230 is at a low level, separation transistor 326 is turned off, thus, sampling transistor 321 only samples the voltage stored in liquid crystal capacitor 313. Separation transistor 326 comprises a drain coupled to a source of switching transistor 324 and a source coupled to liquid crystal capacitor 313 and a drain of sampling transistor 321.

When switching transistors 323 and 324, reference transistor 325, and separation transistor 326 are turned on, the data signal provided by data electrode $D_1$ is transmitted to liquid crystal capacitor 313 through reference transistor 325, switching transistors 323 and 324, and separation transistor 326. In some embodiments, reference transistor 325 and separation transistor 326 can be omitted or a compensation capacitor can be added to pixel module $P_{11}$. With reference to FIG. 3, a compensation capacitor 327 can be coupled between a gate of switching transistor 323 and a gate of sampling transistor 321 for eliminating noise.

Figure 4:
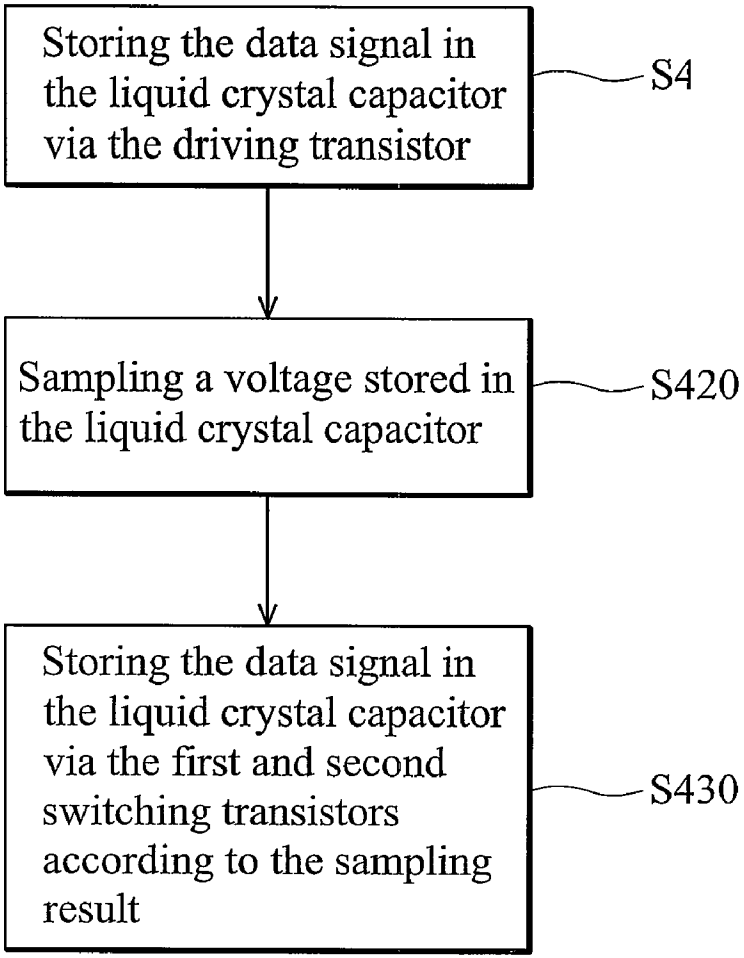
FIG. 4 is a flowchart of a control method.

FIG. 4 is a flowchart of a control method. The control method is appropriate for the pixel module shown in FIG. 3. First, the data signal is stored in the liquid crystal capacitor via the driving transistor (step S410). When the scan signal provided by gate electrode $G_1$ is high, driving transistor 311 is turned on. Thus, the data signal provided by data electrode $D_1$ is stored in storage capacitor 312 and liquid crystal capacitor 313 via driving transistor 311.

Next, a voltage stored in the liquid crystal capacitor is sampled (step S420). When the sampling signal $S_{SAM}$ is high, sampling transistor 321 is turned on for sampling the voltage stored in liquid crystal capacitor 313. At this time, reference transistor 325 is turned on and separation transistor 326 is turned off. After sampling, separation transistor 326 is switched from off to on.

The data signal is stored in the liquid crystal capacitor via the first and second switching transistors according to the sampling result (step S430). Sampling capacitor 322 stores the sampling result. Switching transistors 323 and 324 transmit the data signal provided by data electrode $D_1$ to liquid crystal capacitor 313 according to the voltage stored in sampling capacitor 322. Thus, the voltage stored in liquid crystal capacitor 313 is stabilized.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A sample/hold circuit, appropriate for a pixel unit comprising a liquid crystal capacitor, comprising:
- a sampling transistor coupled to the liquid crystal capacitor for sampling a voltage stored in the liquid crystal capacitor;
- a sampling capacitor storing a sampling result;
- a first switching transistor comprising a gate and a source respectively coupled to two terminals of the sampling capacitor;
- a second switching transistor comprising a gate and a drain respectively coupled to the two terminals of the sampling capacitor; and
- a reference transistor coupled between a data electrode and the first switching transistor.

2. The sample/hold circuit as claimed in claim 1, wherein the reference transistor comprises a drain coupled to the data electrode and a source coupled to a drain of the first switching transistor.

3. The sample/hold circuit as claimed in claim 2, further comprising a separation transistor coupled between the second switching transistor and the liquid crystal capacitor.

4. The sample/hold circuit as claimed in claim 3, wherein the separation transistor comprises a drain coupled to a source of the second switching transistor and a source coupled to the liquid crystal capacitor.

5. The sample/hold circuit as claimed in claim 4, wherein a drain of the sampling transistor is coupled to the source of the separation transistor.

6. The sample/hold circuit as claimed in claim 1, further comprising a compensation capacitor coupled between a gate of the first switching transistor and a gate of the sampling transistor.

7. An electronic system, comprising:
- a plurality of pixel modules, each comprising:
  - a pixel unit coupled to a gate electrode and a data electrode, and comprising:
  - a driving transistor turned on according to a scan signal provided by the gate electrode;
  - a liquid crystal capacitor storing a data signal provided by the data electrode when the driving transistor is turned on; and;
  - a sample/hold circuit comprising:
    - a sampling transistor coupled to the liquid crystal capacitor for sampling a voltage stored in the liquid crystal capacitor;
    - a sampling capacitor storing a sampling result;
    - a first switching transistor comprising a gate and a source respectively coupled to two terminals of the sampling capacitor;
    - a second switching transistor comprising a gate and a drain respectively coupled to the two terminals of the sampling capacitor; and
    - a reference transistor coupled between the data electrode and the first switching transistor.

8. The electronic system as claimed in claim 7, wherein the reference transistor comprises a drain coupled to the data electrode and a source coupled to a drain of the first switching transistor.

9. The electronic system as claimed in claim 8, wherein each pixel module further comprises a separation transistor coupled between the second switching transistor and the liquid crystal capacitor.

10. The electronic system as claimed in claim 9, wherein the separation transistor comprises a drain coupled to a source of the second switching transistor and a source coupled to the liquid crystal capacitor.

11. The electronic system as claimed in claim 10, wherein a drain of the sampling transistor is coupled to the source of the separation transistor.

12. A control method appropriate for the electronic system as claimed in claim 9, comprising:

storing the data signal to the liquid crystal capacitor via the driving transistor;

sampling a voltage stored in the liquid crystal capacitor; and storing the data signal to the liquid crystal capacitor via the first and the second switching transistors according to the sampling result.

13. The control method as claimed in claim 12, wherein when the voltage stored in the liquid crystal capacitor is sampled, the reference transistor is turned on and the separation transistor is turned off.

14. The control method as claimed in claim 12, wherein after the sampling step, the separation transistor is turned on.

15. The electronic system as claimed in claim 7, wherein each pixel module further comprises a compensation capacitor coupled between a gate of the first switching transistor and a gate of the sampling transistor.

16. The electronic system as claimed in claim 7, further comprising:

a gate driver providing the scan signal by the gate electrode;

a source driver providing the data signal by the data electrode; and a power unit providing a power signal to the gate driver and the source driver.

17. The electronic system as claimed in claim 7, further comprising a display unit, wherein the pixel modules form a portion of the display unit.

18. The electronic system as claimed in claim 7, wherein the electronic system is a personal digital assistant (PDA), a notebook computer (NB), a personal computer (PC), digital camera, car TV or a mobile telephone.

* * * * *